US008461748B1

(12) United States Patent
Taj

(10) Patent No.: US 8,461,748 B1
(45) Date of Patent: Jun. 11, 2013

(54) LED LAMP

(75) Inventor: Aijaz Taj, Chino Hills, CA (US)

(73) Assignee: Lights of America, Inc., Walnut, CA (US)

( * ) Notice: Subject to any disclaimer, the term of this patent is extended or adjusted under 35 U.S.C. 154(b) by 84 days.

(21) Appl. No.: 12/931,302

(22) Filed: Jan. 28, 2011

Related U.S. Application Data

(60) Provisional application No. 61/343,448, filed on Apr. 29, 2010.

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.
USPC ..... 313/46; 313/498; 313/512; 313/318.01; 313/318.03; 313/318.04; 362/227; 362/249.01; 362/249.02; 362/249.06; 362/294

(58) Field of Classification Search
USPC ..... 313/498, 46, 512, 318.01, 318.03, 313/318.06; 362/227, 249.01, 249.02, 249.06, 362/294
See application file for complete search history.

(56) References Cited

U.S. PATENT DOCUMENTS

| | | | | |
|---|---|---|---|---|
| 5,931,570 | A | 8/1999 | Yamuro | |
| 6,598,996 | B1 * | 7/2003 | Lodhie | 362/249.05 |
| 7,014,337 | B2 * | 3/2006 | Chen | 362/240 |
| 2003/0039119 | A1 * | 2/2003 | Cao | 362/227 |
| 2004/0022057 | A1 * | 2/2004 | Lee | 362/238 |
| 2005/0068776 | A1 * | 3/2005 | Ge | 362/296 |
| 2005/0168985 | A1 * | 8/2005 | Chen | 362/241 |
| 2005/0213324 | A1 * | 9/2005 | Chen | 362/249 |
| 2007/0291482 | A1 * | 12/2007 | Baroky et al. | 362/227 |
| 2008/0253125 | A1 * | 10/2008 | Kang et al. | 362/294 |
| 2008/0316755 | A1 * | 12/2008 | Zheng et al. | 362/373 |
| 2009/0175041 | A1 * | 7/2009 | Yuen et al. | 362/294 |
| 2009/0195186 | A1 * | 8/2009 | Guest et al. | 315/294 |
| 2009/0273940 | A1 * | 11/2009 | Thurgood et al. | 362/373 |
| 2010/0002444 | A1 | 1/2010 | Konaka | |
| 2010/0259929 | A1 * | 10/2010 | Henri et al. | 362/235 |
| 2010/0314985 | A1 * | 12/2010 | Premysler | 313/46 |
| 2010/0327745 | A1 * | 12/2010 | Dassanayake et al. | 315/35 |
| 2011/0080096 | A1 * | 4/2011 | Dudik et al. | 315/112 |

* cited by examiner

*Primary Examiner* — Nimeshkumar Patel
*Assistant Examiner* — Thomas A Hollweg
(74) *Attorney, Agent, or Firm* — Kuta IP Law, LLC; Christine M. Kuta

(57) ABSTRACT

An LED lamp has an arrangement of LEDs that results in light emitted in a substantially spherical light field. The LED lamp has a bulb-shaped body with at least one LED at the top and a number of LEDs positioned around the circumference of the body. The LEDs are arranged such that light is emitted forward from the lamp and also from the sides of the lamp. Accordingly, the LED lamp, for example, in operation provides illumination in direction and intensity very similar to an incandescent bulb.

15 Claims, 3 Drawing Sheets

LED LAMP

CROSS-REFERENCES

This application claims priority of U.S. provisional application Ser. No. 61/343,448 filed Apr. 29, 2010 and titled "LED Lamp" by the present inventor.

BACKGROUND

Conventionally, incandescent light bulbs have been used for many lighting purposes. The incandescent light bulb, also referred to as an incandescent lamp or incandescent globe, is a source of light resulting from incandescence. Incandescence refers to heat-driven light emissions. In the incandescent light bulb, a thin filament is enclosed in a glass bulb that holds a vacuum or an inert gas. An electric current is supplied to the filament heating the filament to a temperature that produces light. The incandescent bulb typically produces a broad spectrum light that is inherently non-directional. The incandescent bulb also emits a large amount of heat relative to emitted light. For energy conservation purposes and for heat management purposes, alternatives to incandescent bulbs are sought.

A light-emitting diode (LED) is a semiconductor light source that operates through electroluminescence. Forward biased electric current through an LED causes the LED to emit photons. An LED is a highly efficient light source particularly in comparison to incandescent lamps. An LED typically radiates much less heat than an incandescent lamp. LEDs, however, produce light that is directional and so LEDs are generally undesirable for use in applications where a spherical light field is sought.

SUMMARY

An LED lamp has an arrangement of LEDs that results in light emitted in a substantially spherical light field. The LED lamp has a bulb-shaped body with at least one LED at the top and a number of LEDs positioned around the circumference of the body. The LEDs are arranged such that light is emitted forward from the lamp and also from the sides of the lamp. Accordingly, the LED lamp, for example, in operation substantially illuminates a lamp shade of a table lamp as well as providing forwardly directed light. The LED bulb has light distribution which is very similar to a typical A17 or A19 type of incandescent bulb.

The LED lamp further includes a heat sink having a plurality of fins configured to follow the bulb-shaped curve of the lamp body. The LEDs located around the circumference of the lamp are mounted on a flexible printed circuit board, also referred to as a flexible printed wiring board. Typically, between six and twenty-one LEDs are arranged around the circumference of the lamp. The flexible printed circuit board, in one embodiment, is located inside a channel around the body of the lamp. The flexible printed circuit board is wrapped around the lamp inside the channel and the ends of the flexible printed circuit board are inserted through an opening to the interior of the body. A wedge is inserted into the opening with the flexible printed circuit board ends to keep the flexible printed circuit board in place. Further, thermal adhesive between the flexible printed circuit board and the channel serve to keep the flexible printed circuit board in place and also serves to form a thermal connection between the flexible printed circuit board and the heat sink. Covers, or lenses, are positioned over the LEDs at the top and around the circumference.

Each LED emits light in cone-shaped field. The angle of the cone is for example 120°. In one embodiment of the lamp, at least one LED is located at the top and typically between six and twenty-one LEDs are located around the circumference. Together, the cones of light overlap to emit a substantially spherical field of approximately 300°.

It is to be understood that the embodiments shown and described are simply illustrative of the principles of the invention. Various and other modifications and changes may be made by those skilled in the art which will embody the principles of the invention and fall within the spirit and scope thereof.

DRAWINGS

DETAILED DESCRIPTION

An LED lamp has an arrangement of LEDs that results in light emitted in a substantially spherical light field. The LED lamp has a bulb-shaped body with at least one LED at the top and a number of LEDs positioned around the circumference of the body. The LEDs are arranged such that light is emitted forward from the top of the lamp and from the sides of the lamp. Accordingly, the LED lamp, for example, in operation substantially illuminates a lamp shade of a table lamp as well as providing forwardly directed light. Further, the fields of emitted light from the LEDs overlap such that the lamp provides light in a substantially spherical field. The LEDs are mounted in thermal communication with the body. The body of the LED lamp has a plurality of radially arranged fins that increase the surface area of the body and enhance thermal management of the lamp.

Figure 1:
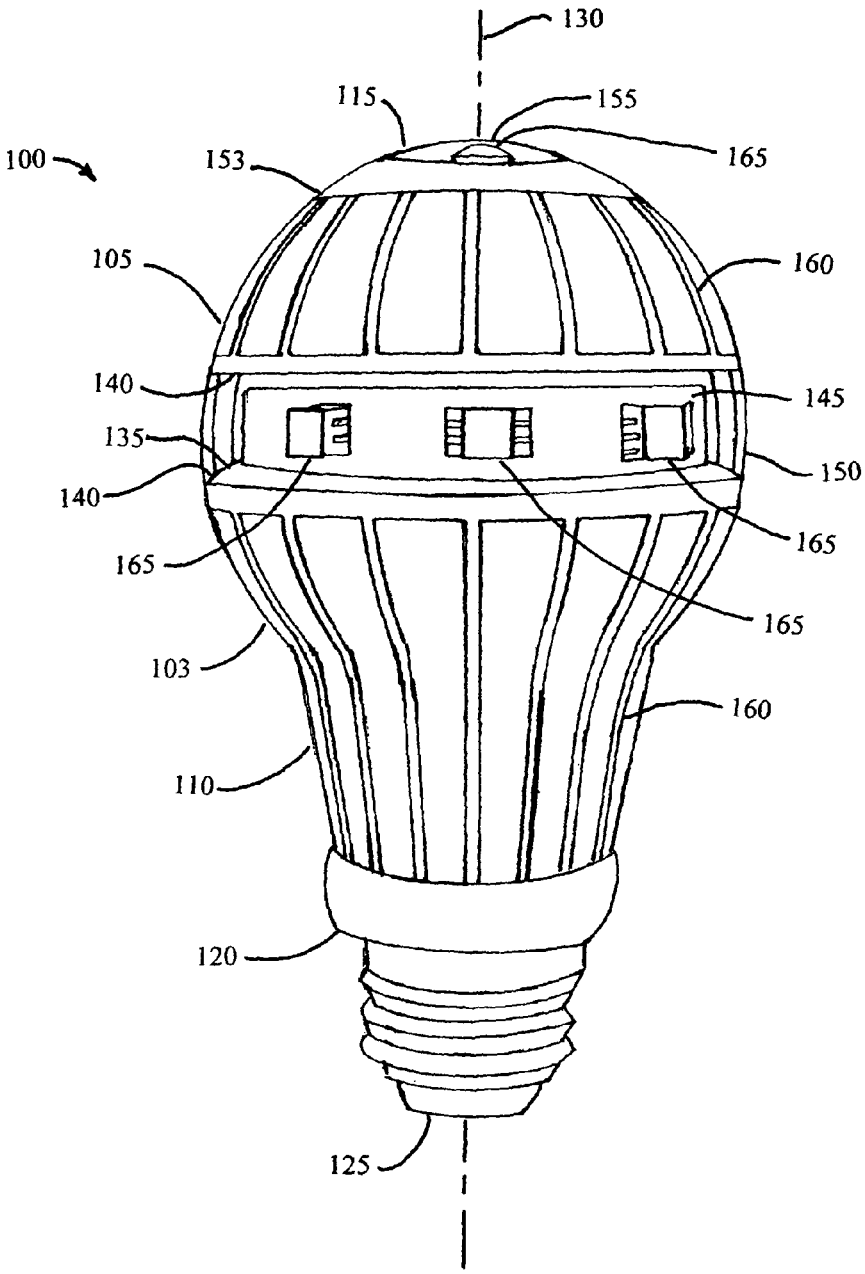
FIG. 1 is a side view of an LED lamp according to principles of the invention.

FIG. 1 is a side view of a first embodiment of an LED lamp 100. The lamp 100 has a bulb-shaped body 103 where the shape is similar to the shape of many incandescent lamps. The lamp 100 has a globe-shaped portion 105 that tapers to a stem 110. For narrative clarity, the portion of the globe 105 opposing the stem 110 is defined as the top 115 of the lamp 100 and the end of the stem 110 is defined as the bottom 120 of the lamp. The lamp bottom 120 is mounted to a standard screw base 125. Other types of lamp bases are possible within the scope of the present embodiment. The present invention is not limited to the base shown here. Further, for narrative purposes, an axis 130 is shown centered through the globe-shaped portion 105 of the lamp 100 and through the stem 110.

A channel 135 encircles the globe-shaped portion 105 of the lamp 100. The channel 135, also referred to as a circumferential channel, is substantially coaxially located with the stem 110. The channel 135 has sides 140 and a back 145. A channel cover 150 is located over the channel 135. The top 115 of the lamp 100 includes a flat area 153 that is covered by a top cover 155. Both covers 150, 155 are configured and arranged to substantially conform to the curvature of the bulb shape of the lamp 100. In one arrangement, the covers are transparent. In an alternative arrangement, the covers are translucent. In a third arrangement, the covers diffuse light and are for example, light diffusing lenses.

Between the top 115 of the lamp 100 and the channel 135 and also between the channel 135 and the bottom 120 of the lamp 100, a plurality of fins 160, also referred to as "blades," are radially located on the lamp body 103 around the axis 130 of the lamp 100. The fins 160 are shaped and configured to conform to the overall bulb shape of the lamp 100. The fins 160 are thermally conductive. The fins 160 are, for example, made of metal or a thermally conductive ceramic.

A plurality of light emitting diodes (LEDs) 165 are mounted in the channel 135. The LEDs 160 in the channel 135 are distributed substantially equidistantly from each other. At least one LED 165 is mounted on the flattened portion 153 at the top 115 of the lamp 100. The LEDs 160 are, for example, surface mount white LEDs such as product number MPL-619 from Unity Opto Technology Co., Ltd. of Taipei, Taiwan or product number STW8Q2PA from Seoul Semiconductor of Seoul, South Korea. These LED types are merely exemplary. One of ordinary skill in the art will understand that other types of LED are possible within the scope of the invention. LEDs typically produce directional light. So, an LED typically emits light in a cone-shaped field. The angle of the cone is for example 120°. In the present embodiment, the LEDs 165 are located at the top of the lamp and around the circumference of the lamp so that the fields of emitted light overlap. Together, the cones of light from the LEDs 160 overlap to emit light from the lamp 100 in a substantially spherical field of approximately 300°.

In addition to providing mount points for LEDs 165, the lamp body 103 acts as a heat sink for the heat generated by the LEDs 165 in operation. The plurality of LEDs mounted in the channel 135 and at the top of the lamp are mounted so that they are in thermal communication with the lamp body 103. In one embodiment, the LEDs 165 are mounted to a flexible circuit board that is attached to the lamp body 103 at the back 140 of the channel 135 with thermally conductive adhesive. The fins, or blades 160 increase the amount of surface area on the lamp body for increased cooling. In some cases, rapid cooling of the LEDs is undesirable. In those cases, the number of fins and accordingly the amount of surface area can be tuned to the desirable cooling rate. Alternatively, the material composition of the lamp body can be composed to conform to the desired thermal management characteristics.

In an alternative embodiment, the lamp is cylindrically shaped with LEDs mounted on the top and mounted in a circumferential channel. In another alternative arrangement, the lamp body is cylindrical between the bottom of the lamp and the circumferential channel and the lamp body is curved above the circumferential channel toward the top forming a half of an oblate spheroid at the top of the lamp above the channel. In a further alternative arrangement, the lamp is bulb-shaped where the upper portion is elongated to form an ellipsoid that tapers to a stem. Further, the stem of the lamp may be shorter or longer in various alternative arrangements.

Figure 2:
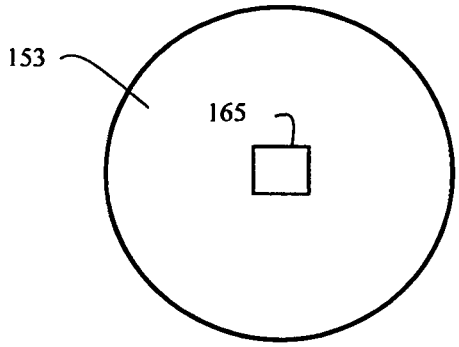
FIG. 2 illustrates the flat area at the top of the LED lamp of FIG. 1.

FIG. 2 shows the flat area 153 under the top cover 155 at the top 115 of the LED lamp 100 of FIG. 1. In the present embodiment, only one LED 165 is mounted to the body 103 of the lamp 100 at the top 115. In alternative embodiments, two or more LEDs are possible. For heat dissipation considerations, a plurality of lower power LEDs may be preferable to a single high-power LED to provide the same level of light. Alternatively, a plurality of LEDs may be preferable in order to generate a greater intensity of light from the top of the lamp 100. In a further alternative embodiment of the lamp 100, the LEDs mounted on the flat area 153 are of different colors selected to provide light of a particular color quality.

Figure 3:
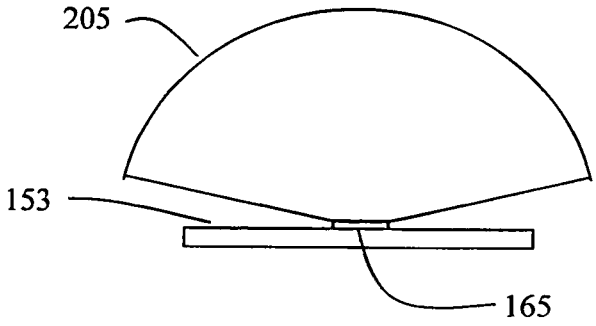
FIG. 3 is a side view illustration of the top-mounted LED of FIG. 2.

FIG. 3 is a side view of the flat area 153 at the top of the lamp 100 of FIG. 1. The LED 165 mounted to the flat area 153 emits directional light. Typically an LED emits light in a cone-shaped field 205. The angle of the field is for example 130°. As described above, in an alternative embodiment, a plurality of LEDs 165 are mounted on the flat area 153. The fields of light would overlap according to the placement of the LEDs 165 on the flat surface.

Figure 4:
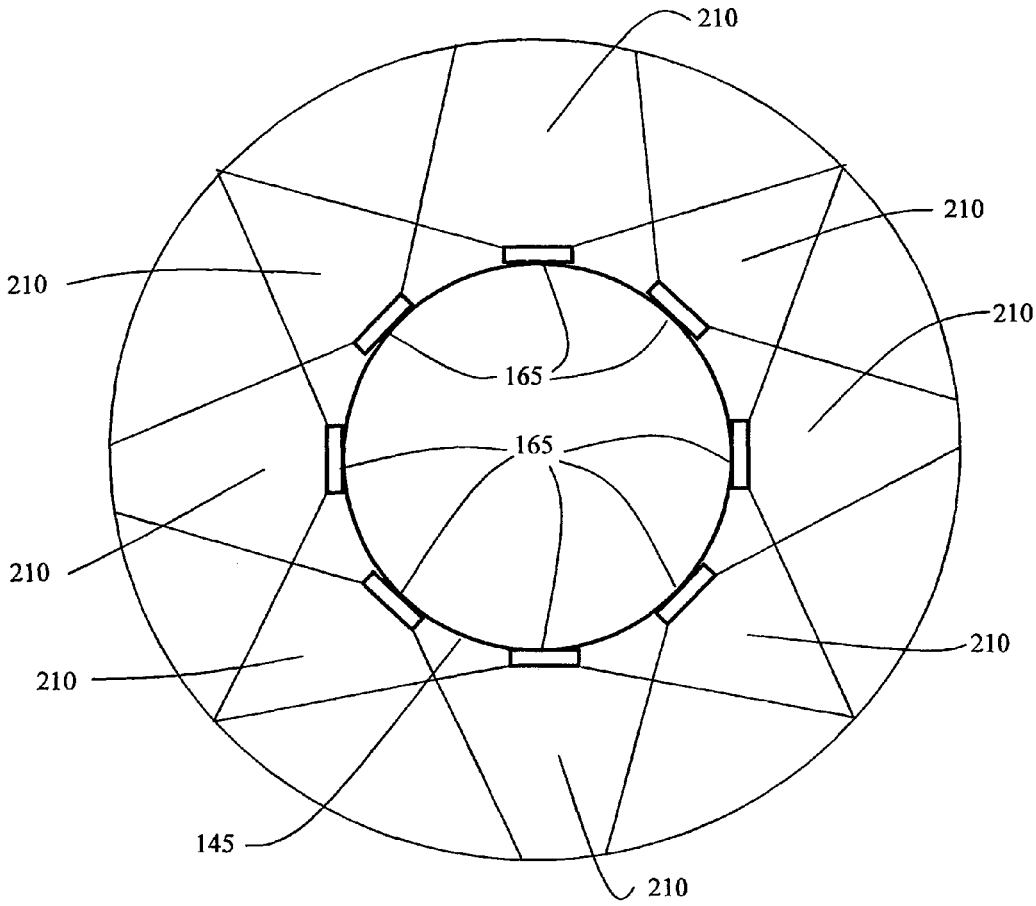
FIG. 4 is illustrates an exemplary placement of LEDs in the channel of the LED lamp of FIG. 1.

FIG. 4 is top view illustration of the channel 135 of the LED lamp 100. The drawing is not to scale nor are the mounting details included. Several LEDs 165 are mounted in the channel 135, to the channel back 145 in a distributed manner. In the present embodiment, the LEDs 165 are mounted so that there is a substantially equal distance between them. Eight LEDs 165 are shown in the present embodiment, however, more or fewer LEDs are possible within the scope of the invention. The fields 210 of light emitted from the LEDs 165 overlap and combine in intensity to light that can appear to have been generated by a point source such as an incandescent bulb. While the illustration is limited to showing the fields of light in two dimensions, it should be understood that each field is actually shaped like a truncated cone. Accordingly, the fields of light 210 from the LEDs 165 mounted in the channel 135 overlap in the present embodiment with the field of light 205 from the LED 165 mounted at the top of the lamp 100 to form a substantially spherical field of light emission from the lamp 100.

It is to be understood that the above-identified embodiments are simply illustrative of the principles of the invention. Various and other modifications and changes may be made by those skilled in the art which will embody the principles of the invention and fall within the spirit and scope thereof.

I claim:

1. An LED lamp, comprising:

a body having a cylindrical shape, the body further having a top and a bottom and a circumferential channel, the circumferential channel having sides and a back, wherein the to has a flat portion, wherein the flat portion has a center point and wherein the body curves toward the center point, the body further having a plurality of radial fins between the circumferential channel and the top, wherein the plurality of radial fins are shaped and configured to conform to the shape of the body;

at least one LED mounted on the top; and a plurality of LEDs mounted to the back of the circumferential channel, the plurality of LEDs mounted in the circumferential channel such that the fields of light from the LEDs overlap.

2. The LED lamp of claim 1 wherein the LEDs are arranged to provide light of increased intensity in a selected direction in reference to the lamp.

3. The LED lamp of claim 1 wherein the LEDs are mounted in thermal communication with the body.

4. The LED lamp of claim 1 wherein the body has a second plurality of radial fins between the circumferential channel and the bottom.

5. The LED lamp of claim 1 wherein the LEDs mounted in the channel are mounted to a flexible circuit board that is attached to the body with thermal adhesive.

6. The LED lamp of claim 1 wherein the circumferential channel has a cover.

7. An LED lamp, comprising:

a body having a cylindrical shape, the body further having a top and a bottom and a circumferential channel, the circumferential channel having sides and a back, and wherein the body has a first plurality of radial fins between the circumferential channel and the top;

at least one LED mounted on the top; and a plurality of LEDs mounted to the back of the circumferential channel, the plurality of LEDs mounted in the circumferential channel such that the fields of light from the LEDs overlap.

8. An LED lamp, comprising:

a body having a cylindrical shape, the body further having a top and a bottom and a circumferential channel, the circumferential channel having sides and a back, and wherein the body is bulb-shaped with a globe-shaped portion that tapers to a stem opposite the top, and wherein the body has a first plurality of radial fins between the circumferential channel and the top and a second plurality of radial fins between the circumferential channel and the bottom, wherein the first plurality and second plurality of fins are shaped and configured to conform to the shape of the body;

at least one LED mounted on the top; and a plurality of LEDs mounted to the back of the circumferential channel, the plurality of LEDs mounted in the circumferential channel such that the fields of light from the LEDs overlap.

9. The LED lamp of claim 8 wherein the LEDs are located and arranged to provide a substantially spherical field of light.

10. The LED lamp of claim 8 wherein the fins are tuned to provide particular thermal management characteristics.

11. The LED lamp of claim 10 wherein the tuning is accomplished by a selected number of fins.

12. The LED lamp of claim 10 wherein the tuning is accomplished by a materials composition of the fins.

13. The LED lamp of claim 10 wherein the tuning is accomplished by the number of fins and by the materials composition of the fins.

14. The LED lamp of claim 8 wherein the top has a first cover and the circumferential channel has a second cover and wherein the first and second covers have curvature configured to conform to the bulb-shaped body.

15. An LED lamp, comprising:

a body having a bulb shape, the body having a first portion that is substantially globe-shaped tapering to a second portion having a smaller radius than the first portion, the body further having a top located on the first portion of the body and a bottom located opposite the top, and a circumferential channel located on the first portion, the circumferential channel having sides and a back, the body further having a first plurality of radial fins between the circumferential channel and the top and a second plurality of radial fins between the circumferential channel and the bottom, wherein the first plurality and second plurality of fins are shaped and configured to conform to the bulb shape of the body;

at least one LED mounted on the top; and a plurality of LEDs mounted to the back of the circumferential channel such that the fields of light from the LEDs overlap.

* * * * *